US005720177A

United States Patent [19]

Derrick et al.

[11] Patent Number: 5,720,177

[45] Date of Patent: Feb. 24, 1998

[54] MULTICHAMBERED PUMP FOR A VAPOR COMPRESSION REFRIGERATION SYSTEM

[75] Inventors: Danny O. Derrick, Columbia; James R. Kirby, Irmo, both of S.C.

[73] Assignee: Danny Derrick, Columbia, S.C.

[21] Appl. No.: 155,523

[22] Filed: Nov. 22, 1993

[51] Int. Cl.[6] ..... F25B 27/00; F01K 13/00

[52] U.S. Cl. ..... 62/115; 62/238.4; 60/676; 417/389

[58] Field of Search ..... 62/238.4, 501, 62/498, 115; 417/389, 383, 379; 60/531, 676

[56] References Cited

U.S. PATENT DOCUMENTS

| | | | |
|---|---|---|---|
| 2,328,462 | 8/1943 | Killeffer . | |
| 3,699,779 | 10/1972 | Schlichtig . | |
| 3,763,663 | 10/1973 | Schlichtig . | |
| 4,418,547 | 12/1983 | Clark, Jr. . | |
| 4,429,540 | 2/1984 | Burnham | 62/235.1 |
| 4,438,633 | 3/1984 | Hiser . | |
| 4,450,690 | 5/1984 | Clark, Jr. . | |
| 4,537,036 | 8/1985 | Clark, III . | |
| 4,537,037 | 8/1985 | Clark, Jr. . | |
| 4,850,199 | 7/1989 | DiNovo et al. . | |
| 5,114,318 | 5/1992 | Freeborn | 417/379 |

FOREIGN PATENT DOCUMENTS

| | | | |
|---|---|---|---|
| 1927713 | 12/1970 | Germany | 417/389 |

*Primary Examiner*—William E. Wayner
*Attorney, Agent, or Firm*—Rogers & Killeen

[57] ABSTRACT

A device and method of operating a diaphragm pump having at least three chambers is used in a vapor compression refrigeration system. Each chamber contains a fluid having a different set of pressure and temperature characteristics. Adjacent chambers are separated by movable barriers, such as flexible diaphragms or pistons, that are sequentially moved by pressure changes resulting from heating and cooling the fluids. The fluids are chosen so that driving fluids operate in a substantially narrower temperature range than a working fluid but have the same operating pressure range permitting use of a thermal energy source having a selected temperature to power the pump. Optimal selection of both driving fluids and the working fluid permits use of a low grade heat source for thermal energy.

13 Claims, 13 Drawing Sheets

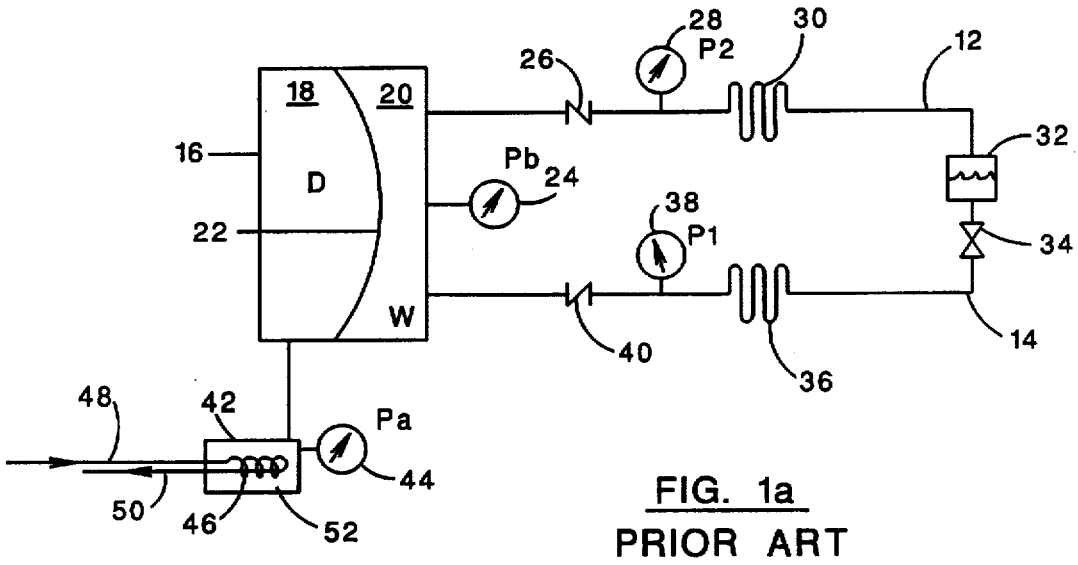
FIG. 1a
PRIOR ART
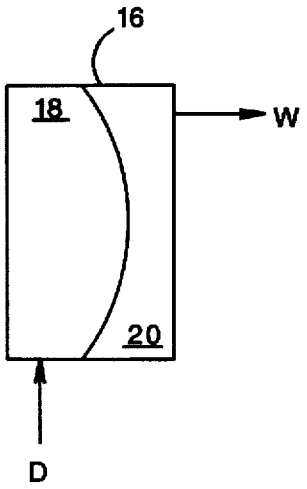
FIG. 1b
PRIOR ART
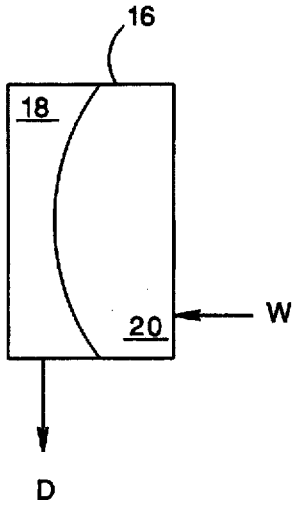
FIG. 1c
PRIOR ART
FIG. 1

COOLING MODE

HEATING MODE

MULTICHAMBERED PUMP FOR A VAPOR COMPRESSION REFRIGERATION SYSTEM

BACKGROUND OF THE INVENTION

The present invention relates to a device and method of operating a pump in a vapor compression refrigeration system, and more particularly to a multichambered pump employed for the refrigeration system compressor that uses a low temperature heat source.

FIG. 1*a* illustrates a known closed cycle vapor compression refrigeration system having a high pressure circuit 12 and a low pressure circuit 14. The compressor is a diaphragm pump 16 having two pump chambers 18 and 20. Pump chamber 18 contains a driving fluid D to pressurize the diaphragm pump 16. Pump chamber 20 contains a working fluid W, for heat transfer within the refrigeration system. The pump chambers are separated by a flexible diaphragm 22.

At the inlet to the high pressure or exhaust side of the refrigeration circuit 12 is a check valve 26 to prevent working fluid W from re-entering the diaphragm pump 16. A pressure gage 28 follows the check valve 26 and precedes a condenser 30 in which the compressed working fluid W gives up its heat of condensation and becomes a liquid. The liquefied working fluid W flows into a receiver 32 that provides a vapor seal to protect the diaphragm pump 16. An expansion valve 34 admits the working fluid W to the low pressure circuit 14 of the refrigeration system resulting in a pressure drop of sufficient magnitude so that some of the working fluid W boils into a vapor before passing into an evaporator coil 36 where the remainder of the liquid working fluid W absorbs heat from the area to be cooled by boiling into a vapor. Following the evaporator is another pressure gage 38 and a second check valve 40 to prevent backflow of working fluid W from the diaphragm pump 16 into the evaporator 36.

Connected to pump chamber 18 of the diaphragm pump 16 is a boiler/condenser 42 having a heat exchanger coil 46 with an inlet 48 and an outlet 50. The body of the boiler/condenser forms a reservoir 52 for the driving fluid D.

In the device of FIG. 1*a*, the refrigeration cycle begins by heating the driving fluid D using the heat exchanger coil 46 of the boiler/condenser 42. The temperature and pressure of the driving fluid D are raised, thereby elevating the pressure in the pump chamber 18, causing the diaphragm 22 to move, and compressing the working fluid W contained in the pump chamber 20.

When the pressure of the working fluid W in the pump chamber 20 exceeds that in the high pressure circuit 12 it is exhausted or expelled through the check valve 26 into the condenser 30 for liquefication. Cooling occurs in the low pressure circuit 14 through expansion of the working fluid W as it changes state from liquid to vapor in the evaporator 36.

Restarting the process with the intake cycle of the diaphragm pump, a cooling agent is admitted to the heat exchanger coil 46 of the boiler/condenser 42 causing the temperature of the driving fluid D to drop reducing the pressure in the pump chamber 18 until the pressure of the working fluid W in the low pressure circuit 14 exceeds the pressure in the pump chamber 18. This causes the working fluid W to pass through the check valve 40 into the pump chamber 20.

FIG. 1*b* illustrates the exhaust cycle of the diaphragm pump. Realignment of the diaphragm 22 when the pump chamber 18 has been pressurized transfers mechanical energy to the working fluid W by compression.

FIG. 1*c* illustrates the intake cycle of the diaphragm pump. The driving fluid D in the pump chamber 18 is cooled thereby reducing its pressure so that it is less than that of the working fluid W resulting in application of force to the diaphragm.

FIG. 2 illustrates the pressure and temperature characteristics of two fluids that could be used in the device shown in FIG. 1*a*. All temperatures are in degrees Fahrenheit. A first fluid is a driving fluid D and a second is a working fluid W. Elevation of driving fluid D's temperature to 170°, shown at T4, raises its pressure to 297 PSIG and increases the temperature of the working fluid W to about 130° (T3). Lowering the temperature of the driving fluid D with a 90° (T2) heat sink causes its pressure to drop to 100 PSIG. The pressure in the pump chamber 20 drops to 100 PSIG as a result. A corresponding decline in the temperature of the working fluid W to about 60° (T1) occurs and is shown at Point 1 in FIG. 2.

The application of diaphragm pumps in vapor compression refrigeration systems is generally known. See, for example U.S. Pat. No. 3,763,663 issued Oct. 9, 1973 to Schlichtig, U.S. Pat. No. 4,537,037 issued Aug. 27, 1985 to Clark. However, the advantages of combining a diaphragm pump having at least three pump chambers with three or more refrigerants operating in the same or similar temperature range but with different pressure characteristics is not reflected in the prior art. As a result, prior art devices must use a relatively high temperature differential in generating the necessary pressure differential between the exhaust and intake cycles of refrigeration system compressor operation.

It is accordingly an object of the present invention to provide a novel device and method for heating and cooling that will use a lower temperature differential than taught by the prior art.

It is another object of the present invention to provide a novel device that uses a low temperature heat source such as a flat plate solar collector or the reclamation of waste heat.

It is a further object of the present invention to provide a novel device with a compressor comprising a diaphragm pump having a plurality of pump chambers.

It is yet a further object of the present invention to provide a novel device having two separate vapor compression refrigeration systems connected to a single multichambered pump compressor where one such system performs a cooling function and the other a heating function.

BRIEF DESCRIPTION OF THE DRAWINGS

FIG. 1*a* is a schematic showing a heat operated device known in the prior art for use as a vapor compression refrigeration system.

FIG. 1*b* illustrates the diaphragm pump of FIG. 1*a* when the pressure in the chamber 18 is greater than the pressure in the chamber 20.

FIG. 1*c* illustrates the diaphragm pump of FIG. 1*a* when the pressure in the chamber 18 is less than the pressure in the chamber 20.

FIG. 4 is a pressure-temperature graph displaying the temperature and pressure characteristics of the working fluid and driving fluids used in the device of FIG. 3a.

FIG. 5 is a pressure-temperature graph displaying the temperature and pressure characteristics of an alternative grouping of fluids used in the device of FIG. 3a.

FIG. 7 displays a pressure-temperature graph showing the temperature and pressure characteristics of five refrigerants used in a diaphragm pump having five pump chambers of the device illustrated in FIG. 6a.

DESCRIPTION OF PREFERRED EMBODIMENTS

Figure 2:
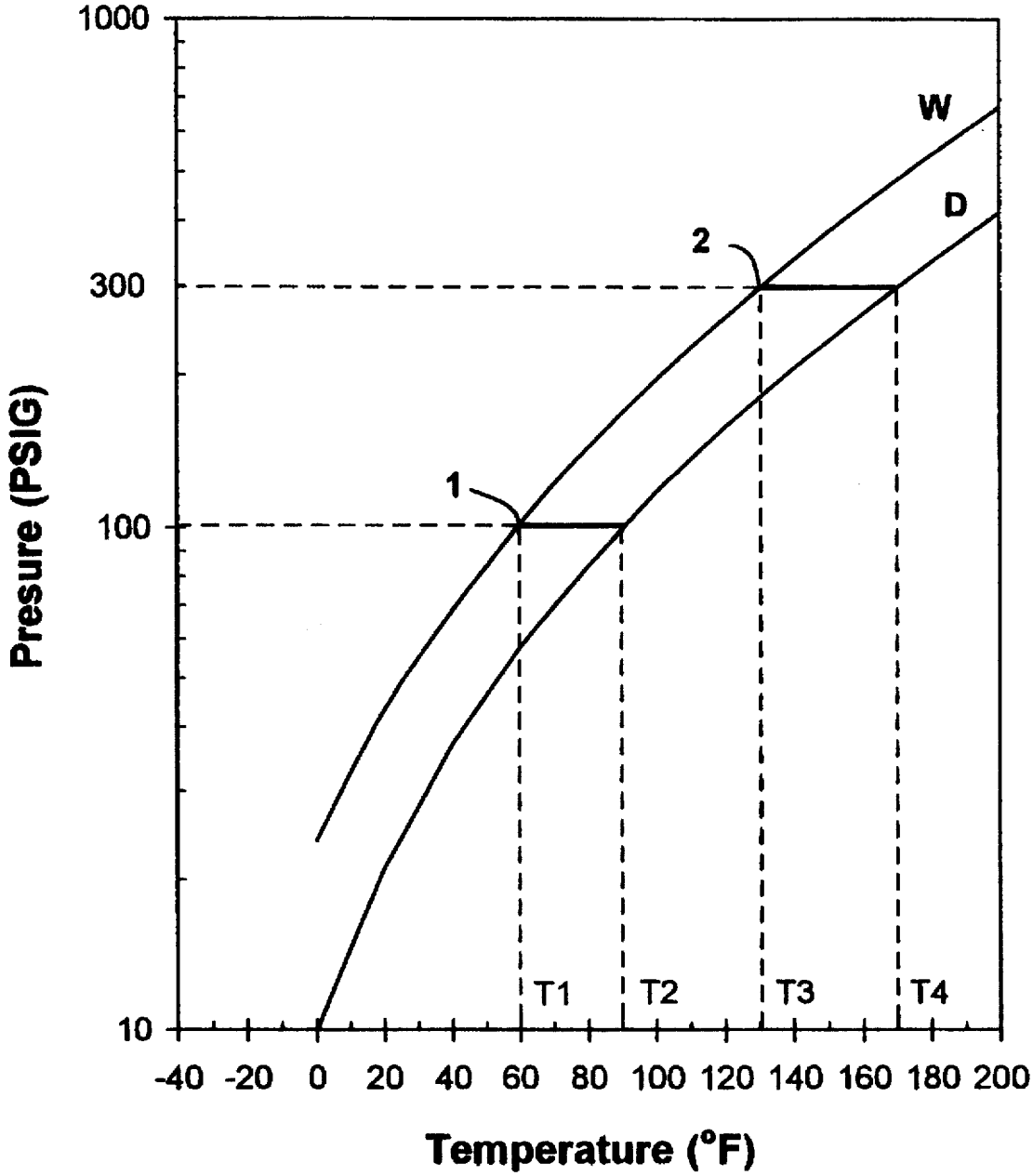
FIG. 2 is a graph displaying the temperature and pressure characteristics of liquid and saturated vapor of the working fluid and driving fluid used as in the device illustrated in FIG. 1*a*.

The present invention finds application in cooling systems, heating systems and combined heating and cooling systems. The following includes examples of cooling systems and combination cooling and heating systems, with heating system embodiments being apparent to those of skill in the art from a reading hereof.

With reference now to FIGS. 3a–d and 4, a cooling system embodiment of the present invention may include a diaphragm pump 102 having two flexible diaphragms 108, 110 that separate the pump into three pump chambers 138, 140 and 142. Pump chamber 140 is connected to a first boiler/condenser 112 and the pump chamber 138 is connected to a second boiler/condenser 114. The latter boiler/condenser can be isolated from pump chamber 138 by a valve 116. A working fluid W enters the high pressure circuit 104 from the pump chamber 142. A check valve 118 prevents backflow of the working fluid W into the diaphragm pump 102. A pressure gage 120, a condenser 122, and a receiver 124 complete the high pressure circuit 104. An expansion valve 126 is the boundary between the high pressure circuit 104 and low pressure 106 circuit. An evaporator 128, pressure gage 130 and a check valve 132 comprise the low pressure circuit 106 which returns the working fluid W to the pump chamber 142.

The pump chamber 138 contains a first driving fluid D1 to move the pump diaphragms 108 and 110 which compress the working fluid W contained in pump chamber 142. Pump chamber 140 contains a second driving fluid D2.

A heat source is applied to the heat exchanger coil 134 of boiler/condenser 114 elevating the temperature and pressure of driving fluid D1. This results in a flow of driving fluid D1 through the valve 116 and into the pump chamber 138. As a result, the pressure within the pump chamber 138 is raised until the diaphragm 108 separating the pump chambers 138 and 140 is moved in the direction of the pump chamber 140. FIG. 3b shows this phase of pump operation and illustrates that both the pump chambers 140 and 142 are compressed. The pressure of the working fluid W is thereby raised until it exceeds the pressure in the high pressure circuit 104 read at the pressure gage 120. When this condition exists the working fluid W is expelled from the pump into the high pressure circuit 104 for heat transfer in the refrigeration system.

To prepare the diaphragm pump 102 so that it will compress the working fluid W for reuse in the refrigeration system, a heat source is applied to the heat exchanger coil 136 of the boiler/condenser 112 which is connected to the pump chamber 140 thereby elevating the temperature and pressure of the driving fluid D2. Simultaneously, a heat sink is applied to the heat exchanger coil 134 of the boiler/condenser 114. This lowers the temperature and pressure of the driving fluid D1 reducing the pressure in the pump chamber 138.

Figure 3A:
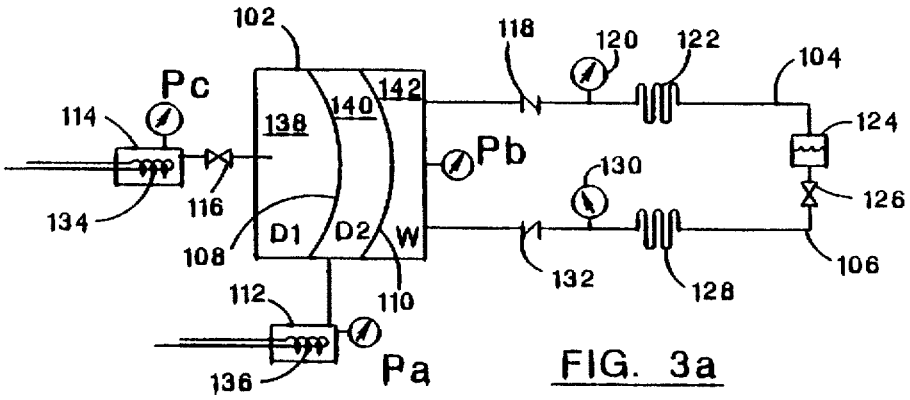
FIG. 3*a* illustrates an embodiment of a heat operated device of the present invention driving a vapor compression refrigeration system.
Figure 3B:
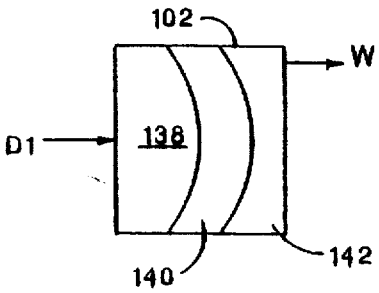
FIG. 3*b* illustrates the diaphragm pump of FIG. 3*a* where pressure in the chamber 138 exceeds the pressure in the chambers 140 and 142.
Figure 3C:
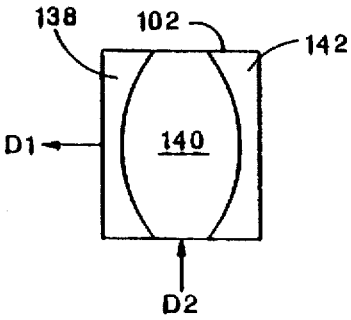
FIG. 3c illustrates the diaphragm pump of FIG. 3a where the pressure in the chamber 140 exceeds the pressure in the chambers 138 and 142.
Figure 3D:
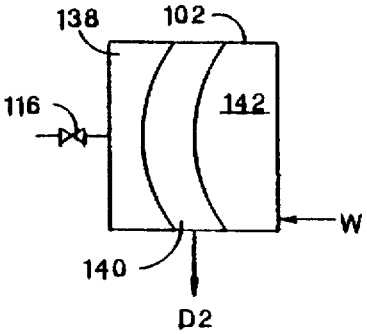
FIG. 3d illustrates the diaphragm pump of FIG. 3a where the pressure in the chamber 142 exceeds the pressure in the chambers 138 and 140.

FIG. 3c reflects the change in alignment of the pump diaphragm 108 resulting from the pressure of driving fluid D2 in the pump chamber 140. The driving fluid D1 is expelled from the pump chamber 138 by this diaphragm movement through the valve 116 and returned to its boiler/condenser 114. The valve 116 is then closed to isolate the pump chamber 138. A heat sink is thereafter applied to the heat exchanger coil 136 of the boiler/condenser 112 causing the pressure and temperature of the driving fluid D2 to drop. This lowers the pressure in the pump chamber 140. When the driving fluid D2's pressure falls below that measured on the pressure gage 130 the working fluid W flows out of the refrigeration system through the check valve 132 and back into the pump chamber 142. A realignment of the diaphragm pump 102 results as shown in FIG. 3d.

The diaphragm pump 102 is prepared for the next cycle by opening the valve 116 and applying a heat source to the boiler/condenser 114. This increases the driving fluid D1's pressure and temperature propelling it into the pump chamber 138 which is thereby pressurized. Movement of the diaphragms 108 and 110 results as illustrated by FIG. 3*b*.

Figure 4:
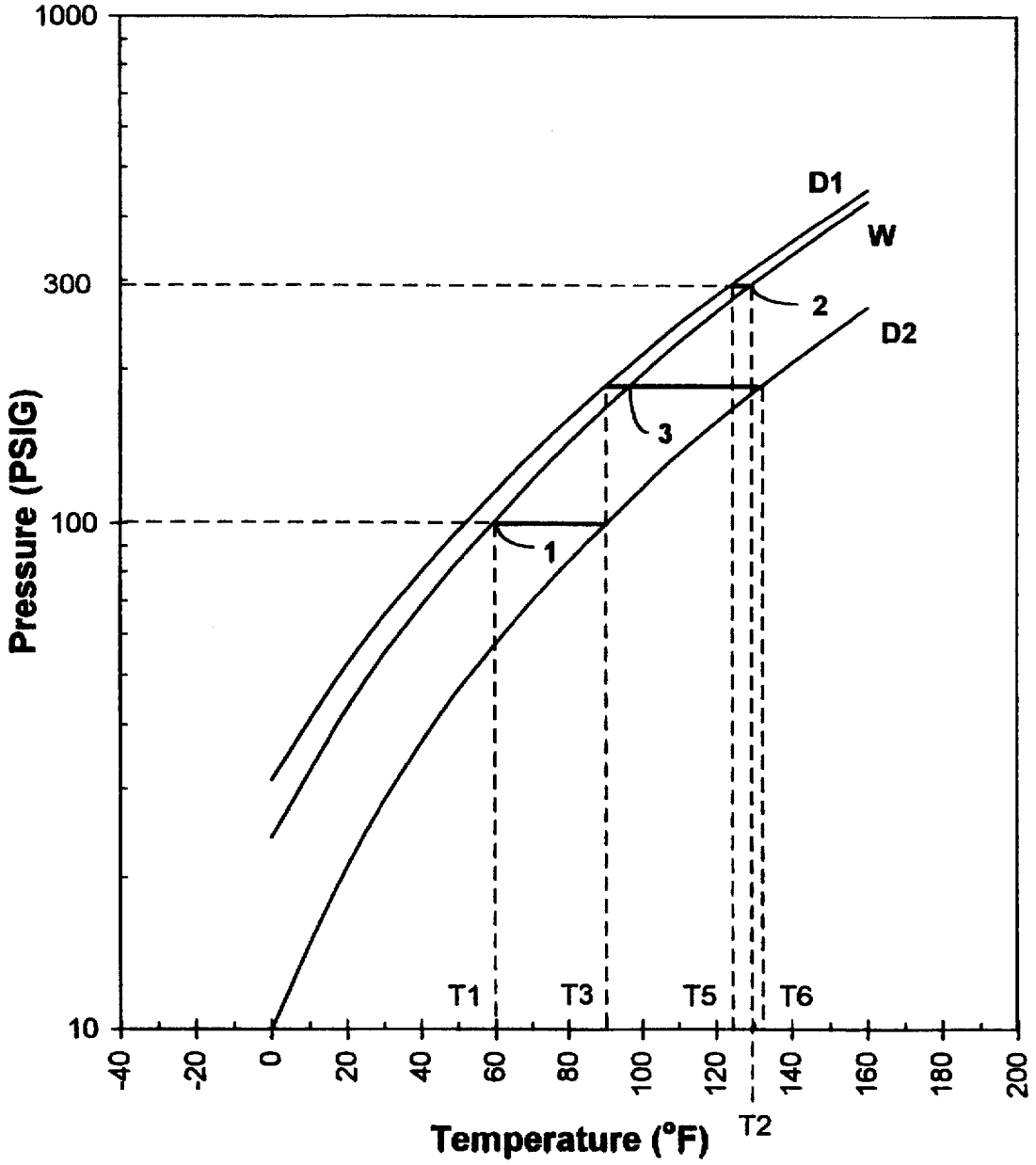

Referring to FIG. 4, a pressure-temperature graph depicts the pressure and temperature characteristics of three exemplary refrigerants used in the device illustrated in FIG. 3*a*. The cited temperatures and pressures are of course for particular refrigerants and will change for different refrigerants.

The driving fluid D1 is heated by a source of 125° (T5) raising its pressure to 297 PSIG. The working fluid W is thereby compressed raising its pressure to 297 PSIG at a temperature of 130° (Point 2 of FIG. 4). It is then expelled from the pump and enters the high pressure circuit of the refrigeration system.

Cooling the driving fluid D1 to the heat sink of 90° (T3) lowers its pressure to 186 PSIG. The driving fluid D2 is heated to 133° (T6) by the heat source and assumes a corresponding pressure of 188 PSIG which forces the driving fluid D1 out of the pump. The pump chamber 138 containing the driving fluid D1 is then isolated and the driving fluid D2 is cooled to 90° causing internal pressure within the diaphragm pump to fall to 100 PSIG. At this pressure the working fluid's corresponding temperature is 59° (Point 1 on FIG. 4). Note that the maximum temperature to which a driving fluid is heated is 133°, compared to 170° in the prior art systems illustrated in FIGS. 1 and 2 that uses the same driving fluid D2.

Figure 5:
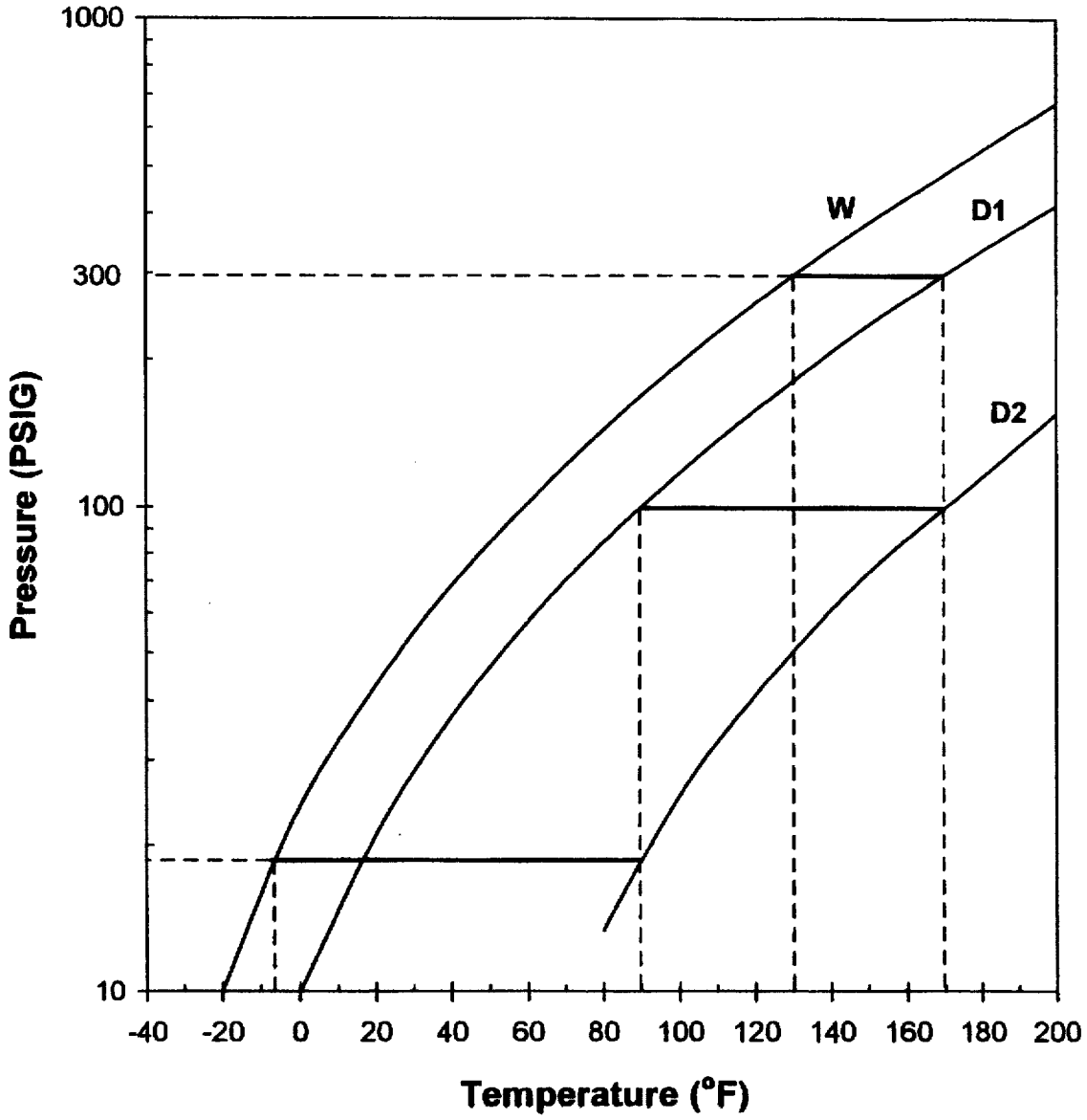

Referring to FIG. 5, it can be seen that by making a substitution of fluids for D1, the performance of the device illustrated in FIG. 3*a* can be improved upon.

Using a heat source of 170° to pressurize the driving fluid D1 to 297 PSIG pressurizes the working fluid W to the same level. Following the same sequence of procedures as before, the driving fluid D2 is heated by the heat source while D1 is cooled by the heat sink temperature of 90° then driving fluid D2 is cooled by the heat sink resulting in a pressure drop to 20 PSIG in both the pump and low pressure circuit of the refrigeration system. The corresponding temperature for a pressure of 20 PSIG in the working refrigerant is about −5° (compared to 60° in the prior art device). Note that both of the driving fluids in this cooling device lie below and to the right of the working fluid on the pressure-temperature graph.

Figure 6A:
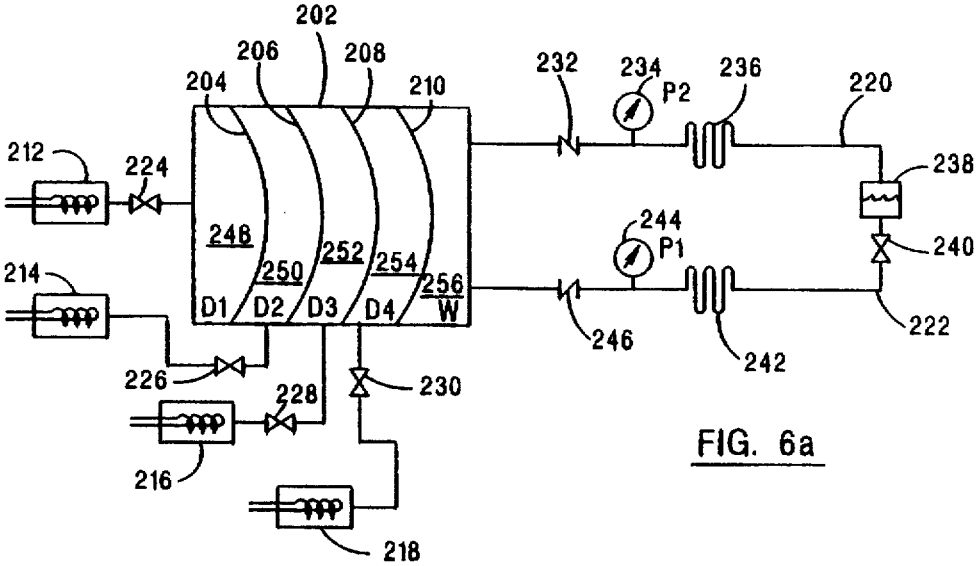
FIG. 6a illustrates another embodiment of the present invention's heat operated device driving a vapor compression refrigeration system.

Performance of the present invention can be further substantially enhanced using an embodiment of the device employing more than two driving fluids. Referring to FIG. 6*a*, a cooling system is illustrated. The diaphragm pump 202 is fitted with four diaphragms 204, 206, 208, 210 subdividing it into five pump chambers 248, 250, 252, 254, 256. Boiler/condensers 212, 214, 216, 218 are linked to pump chambers 248 through 254, respectively. The pump chamber 256 is connected to the refrigeration system at the inlet for the high pressure circuit 220 and the outlet from the low pressure circuit 222.

Figures 6B, 6C, 6D, 6E, 6F:
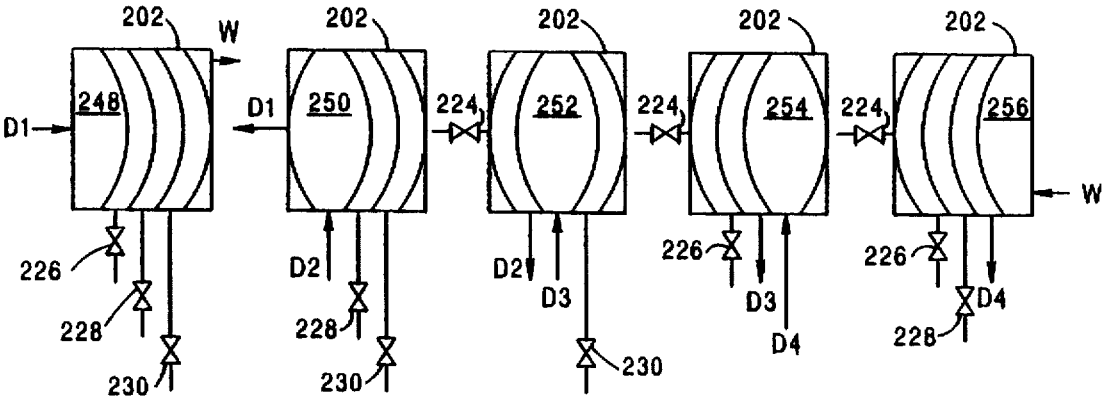
FIG. 6b illustrates the diaphragm pump when the pressure in the chamber 248 exceeds that in the chambers 250, 252, 254, 256 and at the gages 234 and 244.
FIG. 6c illustrates the diaphragm pump when pressure in the chamber 250 exceeds that in the chamber 248.
FIG. 6d illustrates the diaphragm pump when the pressure in the chamber 252 exceeds that in the chamber 250.
FIG. 6e illustrates the diaphragm pump when the pressure in the chamber 254 exceeds that in the chamber 252.
FIG. 6f illustrates the diaphragm pump when the pressure at the gage 244 exceeds the pressure in the chamber 256.

Starting the compression or exhaust cycle of the diaphragm pump, a driving fluid D1 is heated in the heat exchanger 212 by a heat source to a temperature of 135° while the valve 224 is open and the valves 226, 228, 230 connecting the other boiler/condensers to their respective pump chambers are closed. Heating driving fluid D1 pressurizes the pump chamber 248 causing diaphragms 204, 206, 208 and 210 to move as illustrated in FIG. 6*b*. The working refrigerant W is thereby expelled to the high pressure circuit 220 of the refrigeration system and passes through the check valve 232 to the condenser 236 for liquefication and then to collection in the receiver 238 through an expansion valve 240 and into an evaporator 242 from which it feeds into the diaphragm pump chamber 256 through the check valve 246.

The intake or decompression cycle of the diaphragm pump 202 is begun by cooling the driving fluid D1 to 90° using the heat sink with the valve 224 open to the boiler/condenser 212 until the pressure of the driving fluid D2, which is being simultaneously heated, exceeds the pressure of the driving fluid D1. The valve 224 is then closed and the diaphragms align themselves as shown in FIG. 6*c*. The driving fluid D2 is cooled with the valve 226 open until its pressure falls below that of the driving fluid D3 which is being heated. The diaphragms realign themselves at this point as shown in FIG. 6*d* and the valve 226 is closed. The driving fluid D3 is cooled by the heat sink with the valve 228 open until the pressure in the pump chamber 252 falls below that of the driving fluid D4 which is being heated. The diaphragms then realign as shown in FIG. 6*e* and the valve 228 is closed. The driving fluid D4 is then cooled to the temperature of the heat sink with the valve 230 open. When the pressure of the working fluid W exceeds that of the driving fluid D4 then the working fluid W flows into the pump chamber 256, the valve 230 is closed and the cycle repeated. Cooling the driving fluid D4 causes the pressure of the working fluid W to fall from over 300 PSIG to less than 25 PSIG. The temperature of the working fluid W changes from 130° to about −15°. The temperature range of the driving fluids powering the diaphragm pump 202 is maintained within 90°–135° thus permitting the use of a low temperature heat source for effective refrigeration.

Figure 7:
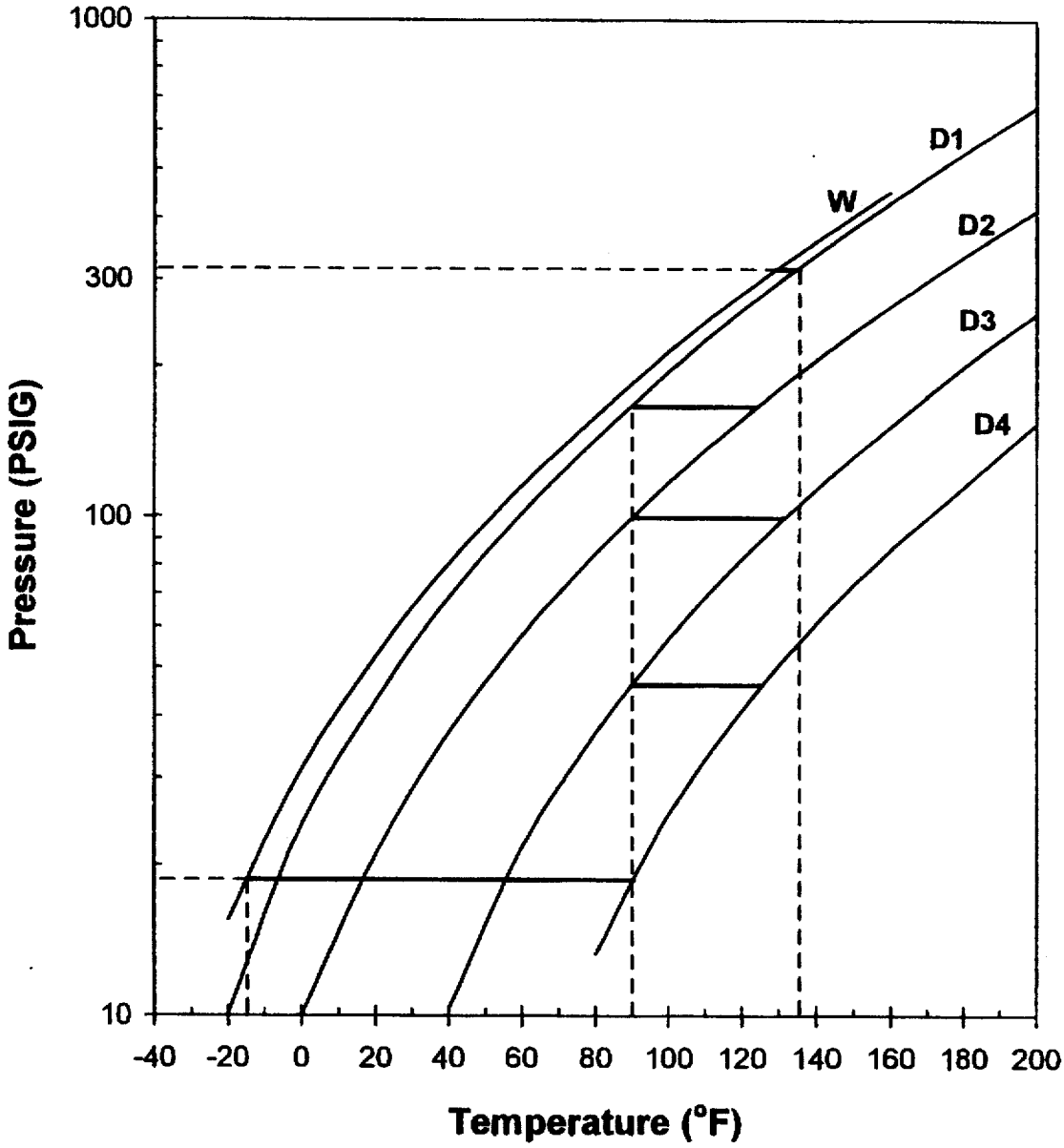

Referring to FIG. 7, the curves for all of the driving fluids used in the device illustrated in FIG. 6*a* lie below and to the right of the working fluid on the pressure-temperature graph. A relatively narrow range between the heat source and heat sink is thus used to exploit the pressure characteristics of each of the driving fluids so that a substantial temperature and pressure differential is achieved with the working fluid to produce a significant cooling effect.

In the present invention, the driving fluid having the highest operating pressure and therefore lying uppermost among the driving fluids on a pressure-temperature graph may be used to elevate the working fluid to the pump exhaust pressure. This enables the system to discharge the heat to the ambient that it acquired while conducting a cooling function in the refrigeration system. The remaining driving fluids lying below and to the right on the pressure-temperature graph are sequentially used to reduce the working fluid's operating pressure so that substantial cooling effect can be achieved.

Figure 8A:
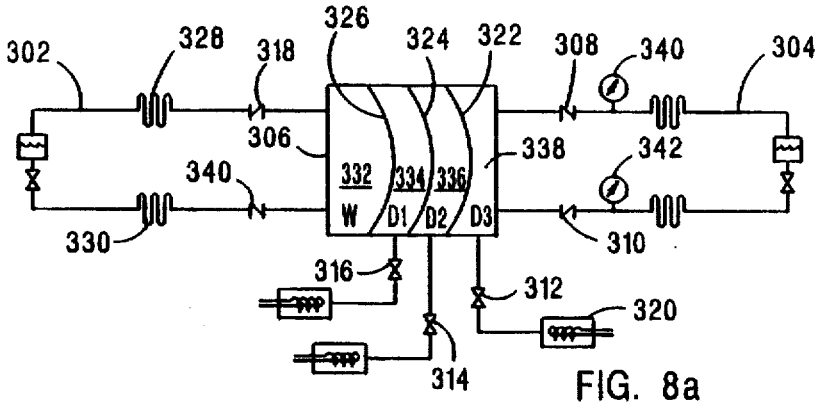
FIG. 8a illustrates an embodiment of the present invention having heating and cooling modes of operation.
Figures 8B, 8C, 8D:
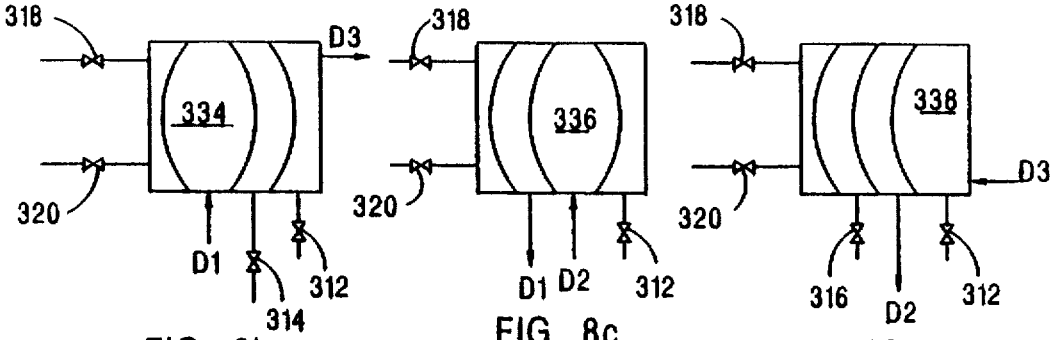
FIG. 8b illustrates the diaphragm pump when the pressure in the chamber 334 exceeds that at the gages 340 and 342.
FIG. 8c illustrates the diaphragm pump when the pressure in the chamber 336 exceeds that in the chamber 334.
FIG. 8d illustrates the diaphragm pump when the pressure at the gage 342 exceeds that in the chamber 338.

Referring to FIG. 8*a*, another embodiment of the invention is illustrated that is suitable for combined heating and cooling systems. A cooling system 304 and a heating system 302 are connected to a common diaphragm pump compressor 306. Only the heating cycle is described since the cooling system operates as previously discussed.

Valves 308 and 310 connecting the diaphragm pump 306 to the cooling system 304 remain closed to isolate that unit while the heating system 302 is in operation. The valve 316 remains closed and the diaphragm chamber 334 is not used when this embodiment is being used for a heating function. The fluids D2 and D3 in the pump chambers 336 and 338, respectively, are the driving fluids during the heating function and the working fluid is W in the pump chamber 332.

Figures 8E, 8F, 8G:
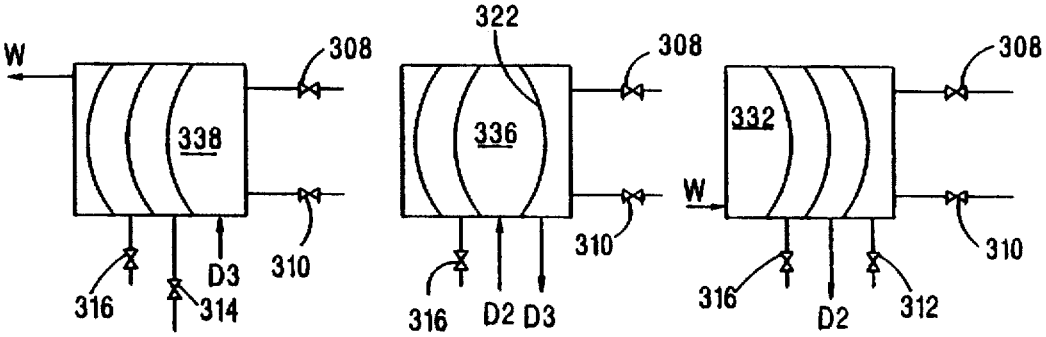
FIG. 8e illustrates the diaphragm pump when the pressure in the chamber 338 exceeds that in the chamber 332.
FIG. 8f illustrates the diaphragm pump when the pressure in the chamber 336 exceeds that in the chamber 338.
FIG. 8g illustrates the diaphragm pump when the pressure in the chamber 332 exceeds that in the chamber 336.

To start the pump exhaust cycle, the driving fluid D3 is heated in the boiler/condenser 320. This pressurizes the pump chamber 338. When the pressure of the driving fluid D3 exceeds that of the driving fluid D2 and the working fluid W then the diaphragms 322, 324 and 326 realign as shown in FIG. 8*e* compressing the working fluid W and raising both its pressure and temperature. This expels the working fluid W into the heating system 302. In a condenser 328, the working fluid W releases heat as it is liquefied thereby performing the heating function of the system.

Preparation of the diaphragm pump 306 for the next cycle begins by heating the driving fluid D2 with the heat source to pressurize the pump chamber 336 while leaving the valve 312 open and cooling the driving fluid D3. When the driving fluid D2 exceeds the pressure of the driving fluid D3 the diaphragm 322 is realigned as shown in FIG. 8*f*. The driving fluid D3 is expelled from the pump chamber 338 by movement of the diaphragm 322 after which the valve 312 is closed. The driving fluid D2 is then cooled to the heat sink temperature until its pressure is less than that of the working fluid W which then passes through the check valve 340 to re-enter the pump chamber 332 and realign the diaphragms 324 and 326 as illustrated in FIG. 8*g*.

Figure 9:
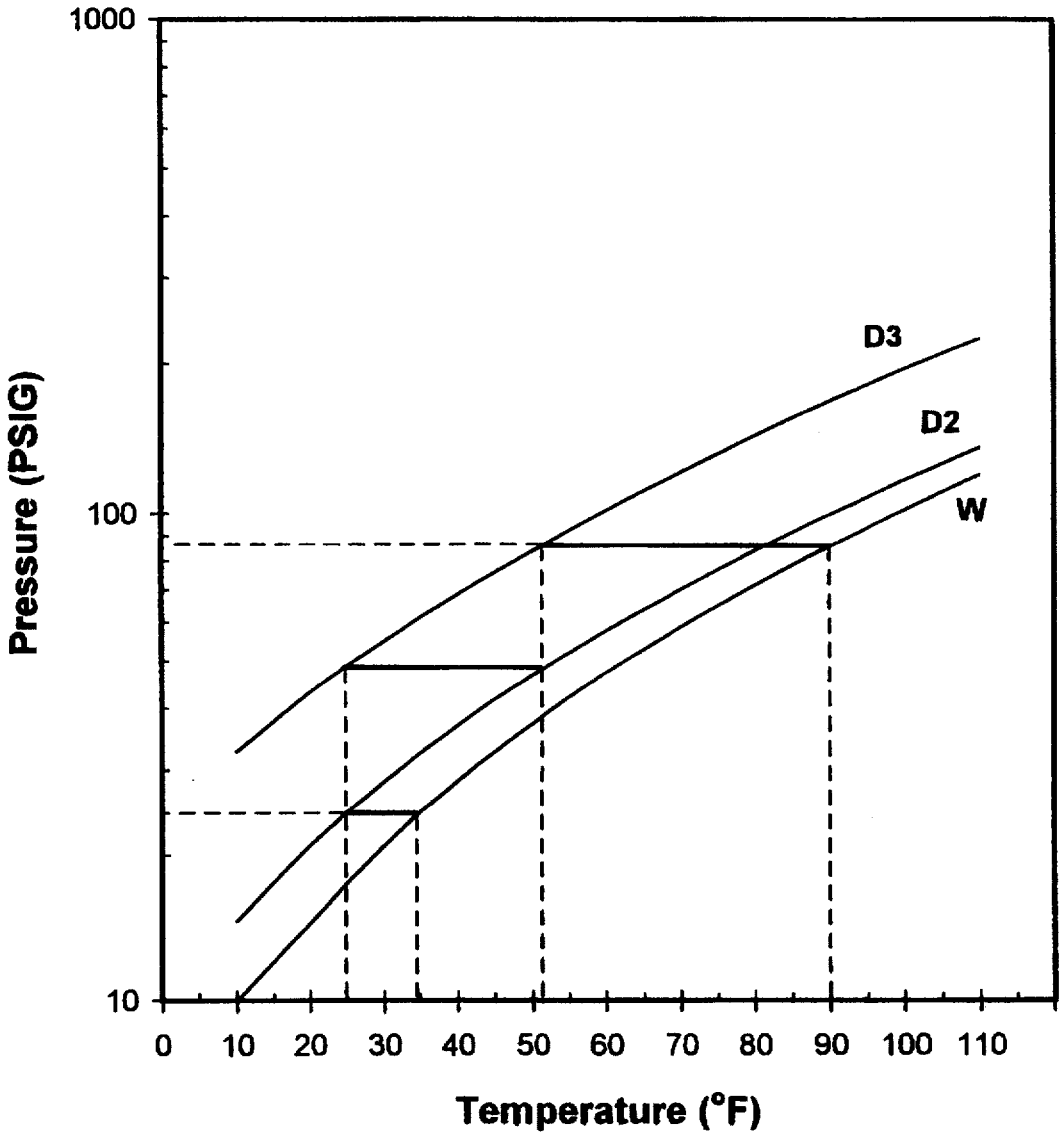
FIG. 9 displays a pressure-temperature graph showing the device of the present invention as illustrated in FIG. 8a used as a heating system.

FIG. 9 shows a pressure-temperature graph illustrating the relationships between the fluids used in the device shown in FIG. 8*a*. The working fluid W is heated from a temperature of less than 35° to 90° resulting in an increase in pressure from less than 25 PSIG to more than 85 PSIG. The temperature of the driving refrigerants D2 and D3 is maintained between 25° and 50° Note that since this embodiment is used for heating, both of the driving fluids lie above and to the left of the working fluid on the pressure-temperature graph. As in the cooling system embodiments, performance may be further enhanced by using additional driving fluids.

Figure 10:
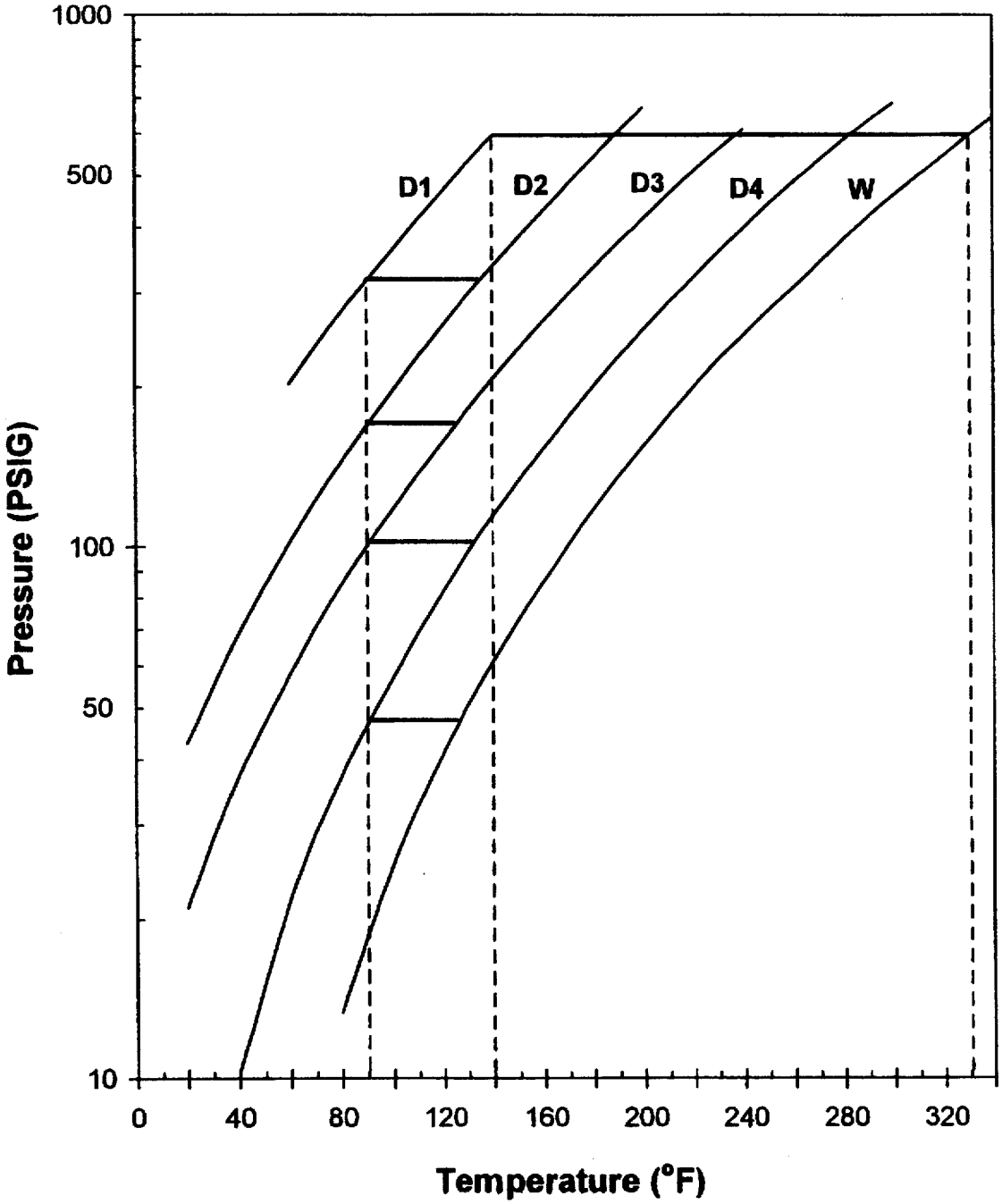
FIG. 10 displays a pressure-temperature graph showing the device of the present invention as illustrated in FIG. 6a used for an expanded heating range.

For example, and with reference to FIG. 10, a pressure-temperature graph for a heating system that uses four driving fluids in a pump such as illustrated in FIG. 6*a* is shown.

The working fluid W illustrated in FIG. 10 is pressurized to more than 500 PSIG at a corresponding temperature of more than 300° by heating the driving fluid D1 to a heat source temperature of 140°. The working fluid W pressure is then reduced to less than 50 PSIG and 130° by first cooling the driving fluid D1 to a heat sink temperature of 90° while simultaneously heating the driving fluid D2. The driving fluid D2 is next cooled as the driving fluid D3 is heated. Then the driving fluid D3 is cooled while the driving fluid D4 is heated. Finally, the driving fluid D4 is cooled thereby reducing the temperature of the working fluid W below the heat source temperature allowing it to receive energy from the heat source. This embodiment of the invention is therefore capable of achieving a temperature of 310° using a heat source temperature that does not exceed 140°.

As in the heating device portrayed in FIG. 8*a*, note that the driving fluids all lie above and to the left of the working fluid on the pressure-temperature graph. Also note that in general terms, the driving fluid having the highest operating pressure may be used to elevate the pressure and temperature of the working fluid to its exhaust parameters for heat transfer in the heating system. The remaining driving fluids in a heating device are used to sequentially reposition or cock the diaphragms of the compressor so that it is prepared for its intake cycle.

Figure 11:
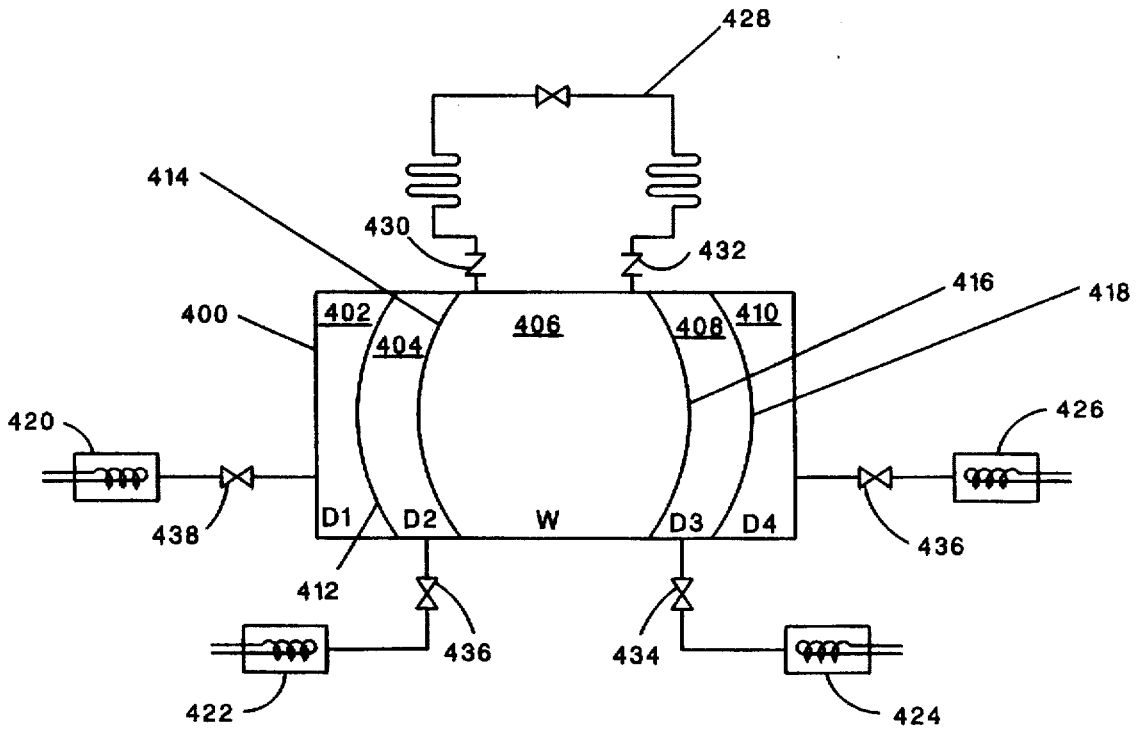
FIG. 11 illustrates an alternative embodiment of the diaphragm pump that can be used for either heating or cooling but has only one vapor compression refrigeration system connected thereto.
Figure 12:
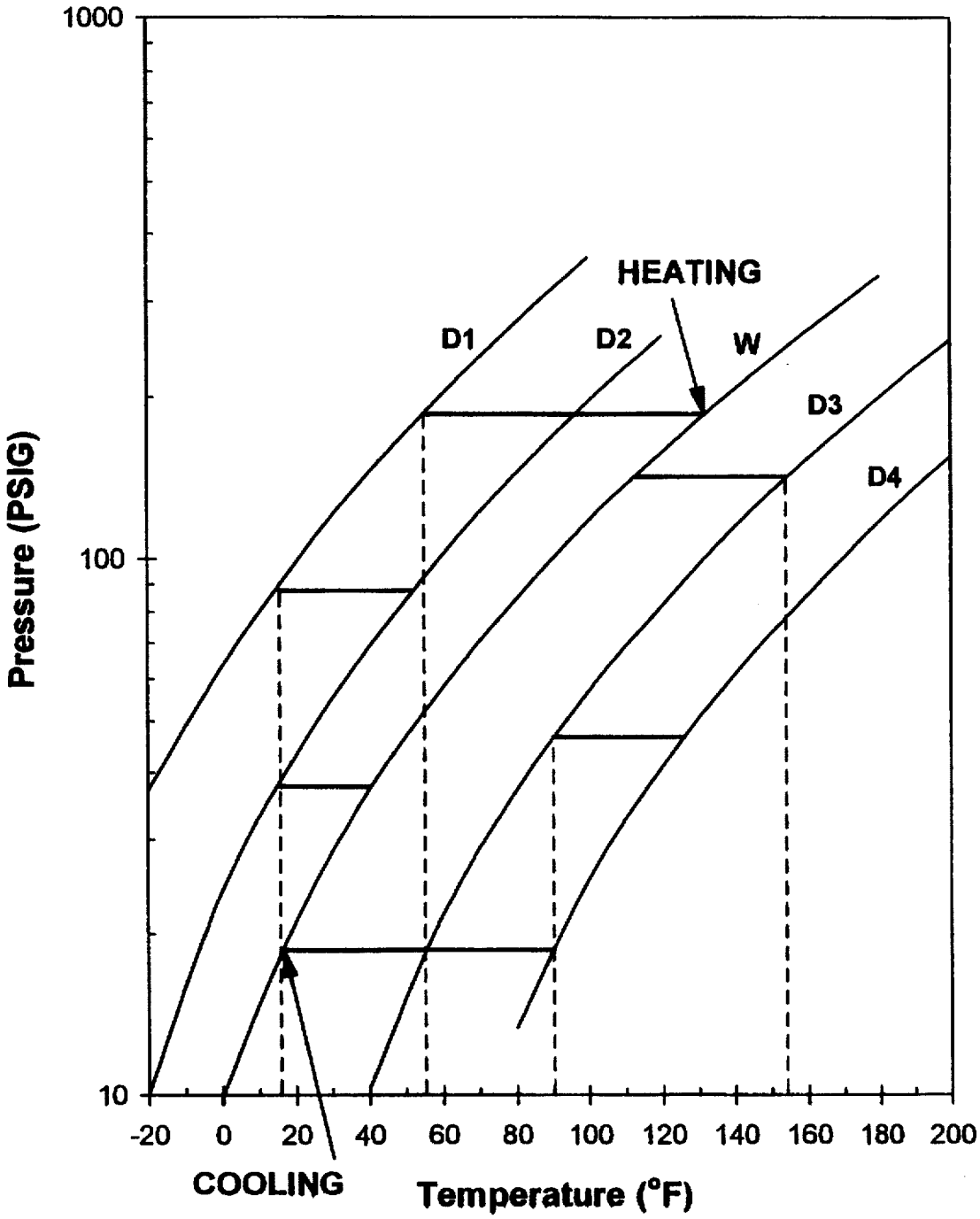
FIG. 12 displays a pressure-temperature graph showing the device of the present invention as illustrated in FIG. 11 used for heating or cooling.

FIG. 11 illustrates an alternative embodiment of the combination system for heating and cooling. A pump 400 contains five chambers 402, 404, 406, 408, 410 separated by diaphragms 412, 414, 416, 418. Boiler/condenser means 420, 422, 424, 426 are connected to respective pump chambers, except the middle chamber that is for the working fluid. A vapor compression refrigeration unit 428 is connected at each terminus thereof by reversing check valves 430, 432 to pump chamber 406. Chambers 402 and 404 contain driving fluids D1 and D2 and pump chamber 406 contains a working fluid W. Referring to FIG. 12, note that driving fluids D1 and D2 have pressure-temperature characteristics falling above and to the left of those for the working fluid W. This permits the use of these fluids for heating.

Driving fluid D1 is heated from ambient to a predetermined temperature moving diaphragms 412 and 414 toward pump chamber 406 pressurizing it and thereby forcing the working fluid W into the vapor compression refrigeration unit 428. Driving fluid D2 is then heated while driving fluid D1 is cooled causing diaphragm 412 to move toward pump chamber 402 while diaphragm 414 remains in position toward pump chamber 406. Driving fluid D2 is then cooled reducing the pressure in pump chamber 404 so that working fluid W will re-enter pump chamber 406. During use as a heating system, pump chambers 408 and 410 are empty and isolated from their respective boiler/condenser means 424, 426 by closing valves 434 and 436.

To operate the device illustrated in FIG. 11 as a cooler, pump chambers 402 and 404 are evacuated and isolated from their respective boiler/condenser means 420, 422 by closing valves 436 and 438. Driving fluid D4 in pump chamber 410 is then heated from ambient to a predetermined temperature causing diaphragms 418 and 416 to move toward pump chamber 406 forcing the working fluid W into the vapor compression refrigeration system 428. Driving fluid D3 is then heated while cooling driving fluid D4 to pressurize pump chamber 408. Driving fluid D3 is then cooled reducing the pressure in pump chamber 408 so that working fluid W may reenter pump chamber 406.

Referring again to FIG. 12, note that driving fluids D3 and D4 lie below and to the right of working fluid W in their pressure-temperature characteristics thereby permitting their use to depress the temperature of working fluid W.

Figure 13:
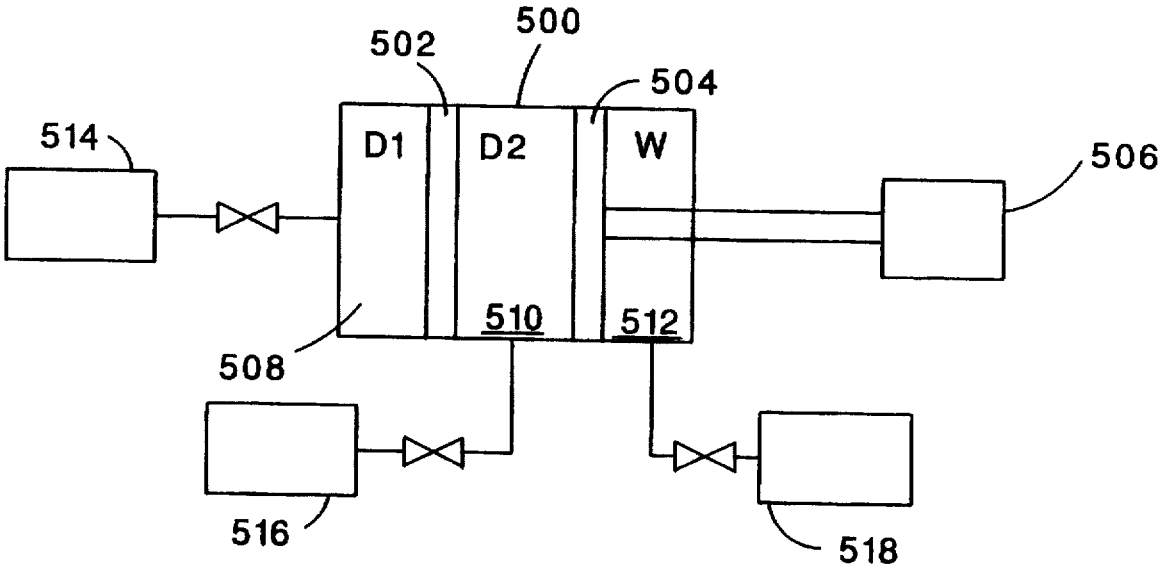
FIG. 13 is another alternative embodiment of the present invention illustrating diaphragms that are pistons.

With reference now to FIG. 13, in an alternative embodiment the diaphragms in the diaphragm pumps may be rigid rather than flexible. For example, the diaphragms may be pistons 502, 504 that move longitudinally through a cylinder 500. Movement of the pistons 502, 504 may perform mechanical work on an attached device 506 in addition to or instead of powering a closed cycle vapor compression refrigeration system. The chambers 508 and 510 may contain driving fluids D1 and D2 and chamber 512 a working fluid W. Each chamber of the cylinder is connected to a heat transfer system 514, 516 and 518 that operate as previously disclosed.

The following table contains a list of refrigerants that have been found to be suitable as either a working fluid W or a driving fluid D1–D4. The designations used are those of the ASHRAE refrigerant numbering system.

| Refrigerant Number | Chemical Name | Chemical Formula |
|---|---|---|
| R-12 | dichlorodifluoromethane | $CCl_2F_2$ |
| R-21 | dichlorofluoromethane | $CHCl_2F$ |
| R-22 | chlorodifluoromethane | $CHClF_2$ |
| R-40 | methyl chloride | $CH_3Cl$ |
| R-142b | chlorodifluoroethane | $CH_3CClF_2$ |

-continued

| Refrigerant Number | Chemical Name | Chemical Formula |
|---|---|---|
| R-502 | azeotrope of R-12 and R-115 | $CHClF_2/CClF_2CF_3$ |
| R-504 | azeotrope of R-32 and R-115 | $CH_2F_2/CClF_2CF_3$ |

The refrigerants used in the various embodiments disclosed may vary. For example, the embodiment of the present invention illustrated in FIG. 4 may use R-22 as a working fluid W, R-502 as the first driving fluid D1 and R-12 as a second driving fluid D2. While in FIG. 7, R-502 may be the working fluid W, R-22 driving fluid D1, R-12 driving fluid D2, R-142*b* driving fluid D3 and R-21 driving fluid D4, and in FIG. 10 the working fluid W may be refrigerant R-21 and the driving fluids may be R-504 for D1, R-22 for D-2, R-12 for D3 and R-142*b* for D4.

The refrigerants in the embodiments were selected to optimize particular attributes. Each driving fluid possesses a significant pressure differential for a relatively modest difference between the temperatures of a heat source and a heat sink. Other refrigerants and combinations of refrigerants may be equally suitable and the present invention is not to be limited to the particular refrigerants disclosed.

While preferred embodiments of the present invention have been described, it is to be understood that the embodiments described are illustrative only and the scope of the invention is to be defined solely by the appended claims when accorded a full range of equivalence, many variations and modifications naturally occurring to those skilled in the art from a perusal hereof.

What is claimed is:

1. In a method of operating a pump with at least three chambers that are separated by flexible diaphragms, wherein a working fluid moving through one of the chambers of the pump is within a predetermined working temperature range, the improvement comprising the steps of;

(a) providing a plurality of driving fluids, each moving through a separate one of the other at least three chambers, to operate the pump;

(b) expelling the working fluid from the one chamber by introducing a first of the driving fluids into a second of the chambers; and (c) expelling the first driving fluid from the second chamber by introducing a second of the driving fluids into a third of the chambers.

2. The method of claim 1 wherein the plurality of driving fluids operate within a predetermined driving temperature range that is narrower than the working temperature range.

3. The method of claim 1 wherein the driving pressure range of the plurality of said driving fluids determines the working temperature range of said working fluid.

4. A method of effecting pressure changes in a working fluid in a first chamber of a multichambered compressor for a vapor compression refrigeration system, the method comprising the steps of:

(a) varying the temperature of a first of a plurality of driving fluids, the first driving fluid being driven through a second one of the chambers by the varying temperature, thereby changing the volume of the first chamber through which the working fluid moves; and (b) varying the temperature of a second one of the driving fluids, the second driving fluid being driven through a third one of the chambers by the varying temperature to change the volume of the second chamber while maintaining the volume of the first chamber.

5. The method of claim 4 wherein the step of varying the temperature comprises the step of increasing the temperature of a first one of the driving fluids to compress the working fluid.

6. The method of claim 5 wherein the step of varying the temperature further comprises the steps of cooling the first driving fluid while simultaneously heating a second of the driving fluids, and thereafter cooling the second driving fluid to decompress the working fluid.

7. A method of driving a vapor compression refrigeration system with a thermal powered pump having at least three chambers separated by movable means, wherein a working fluid moves through a first of the chambers and the vapor compression refrigeration system and driving fluids in the remainder of the chambers move through respective heat transfer means, the method comprising the steps of;

heating a first one of the driving fluids to urge a first movable means to compress the first chamber to move the working fluid from the first chamber into the refrigeration system;

heating a second of the driving fluids while simultaneously cooling the first driving fluid to urge the first movable means to move the first driving fluid into its respective heat transfer means and to maintain the compression of the first chamber; and cooling the second driving fluid to urge a second movable means to expand the first chamber to move the working fluid from the vapor compression refrigeration system into the first chamber and to move the second driving fluid into its respective heat transfer means.

8. The method of claim 7 wherein the vapor compression refrigeration system is a cooling system and further comprising the steps of:

heating the first driving fluid to a predetermined temperature at which the first driving fluid has substantially the same pressure as the working fluid at a temperature lower than the predetermined temperature;

heating the second driving fluid to the predetermined temperature while cooling the first driving fluid to a second predetermined temperature at which the pressure of the driving fluids is substantially the same; and cooling the second driving fluid to the second predetermined temperature so that the pressure of the working fluid is substantially the same as the pressure of the second driving fluid while the temperature of the working fluid is less than the second predetermined temperature.

9. The method of claim 7 wherein the vapor compression refrigeration system is a heating system and further comprising the steps of:

heating the first driving fluid to a predetermined temperature at which the driving fluid has a pressure substantially the same as the pressure of the working fluid at a temperature higher than the predetermined temperature;

heating the second driving fluid to the predetermined temperature while cooling the first driving fluid to a second predetermined temperature at which the pressure of the driving fluids is substantially the same; and cooling the second driving fluid to the second predetermined temperature so that the pressure of the working fluid is substantially the same as the pressure of the second driving fluid while the temperature of the working fluid is higher than the second predetermined temperature.

10. A pump comprising:

at least three chambers;

a flexible diaphragm between each of said at least three chambers;

a working fluid moving through a first one of said at least three chambers within a predetermined working temperature range;

a plurality of driving fluids, each moving through a separate one of the other said at least three chambers for operating the pump;

means for heating a first one of said driving fluids to cause said first driving fluid to expand into a second of said at least three chambers and thereby compress said working fluid in said first chamber; and means for heating a second one of said driving fluids while simultaneously not heating said first driving fluid to cause said second driving fluid to expand into a third of said at least three chambers and thereby expel said first driving fluid from said second chamber while maintaining the compression of said working fluid in said first chamber.

11. The pump of claim 10 wherein said plurality of driving fluids operate within a predetermined driving temperature range that is narrower than said working temperature range.

12. A method of effecting pressure changes in a working fluid in a first chamber of a multichambered compressor for a vapor compression refrigeration system, the method comprising the steps of:

(a) heating a first driving fluid to compress the working fluid in the first chamber and to compress a second driving fluid in a third chamber, the first driving fluid expanding in a second chamber of the compressor as a result of the heating;

(b) cooling the first driving fluid while simultaneously heating the second driving fluid, the second driving fluid expanding in the third chamber of the compressor as a result of the heating to maintain the compression of the working fluid in the first chamber;

(c) cooling the second driving fluid to cause the working fluid to enter the first chamber; and (d) repeating steps (a)–(c) to cyclically expel the working fluid from the first chamber by the heating and cooling of the driving fluids.

13. A method of moving a working fluid into and out of a first chamber of a multichambered pump, the method comprising the steps of:

(a) heating a first driving fluid to thereby increase the pressure in a second chamber which causes the first chamber to compress so that the working fluid is expelled from the first chamber;

(b) cooling the first driving fluid while simultaneously heating a second driving fluid to decrease the pressure in the second chamber and increase the pressure in a third chamber into which the second driving fluid expands, wherein expansion of the third chamber maintains compression of the first chamber;

(c) cooling the second driving fluid to thereby decrease the pressure in the third chamber so that the working fluid is drawn into the first chamber; and (d) repeating steps (a)–(c).

* * * * *